US005416982A

United States Patent [19]

Nishimura

[11] Patent Number: 5,416,982

[45] Date of Patent: May 23, 1995

[54] MOISTURE SEALING APPARATUS FOR POWDERY BRAZING FLUX

[76] Inventor: Makoto Nishimura, No. 1-28-5, Toyotama-Naka, Nerima-Ku, Tokyo, Japan

[21] Appl. No.: 160,778

[22] Filed: Dec. 3, 1993

[30] Foreign Application Priority Data

Dec. 8, 1992 [JP] Japan ..... 4-351451

[51] Int. Cl.[6] ..... F26B 21/12

[52] U.S. Cl. ..... 34/241; 454/188; 34/218

[58] Field of Search ..... 34/241, 218, 577; 454/188, 193

[56] References Cited

U.S. PATENT DOCUMENTS 3,097,916 7/1963 Dawson et al. ..... 34/218

3,270,655 9/1966 Guirl et al. ..... 454/188

4,714,097 12/1987 Binzen et al. ..... 454/188

5,154,008 10/1992 Chicot ..... 34/218

FOREIGN PATENT DOCUMENTS 126666 5/1988 Japan .

*Primary Examiner*—Denise L. Gromada

*Attorney, Agent, or Firm*—Browdy and Neimark

[57] ABSTRACT

Disclosed herein is a moisture sealing apparatus for a powdery brazing flux, comprising an open-topped container for the powdery brazing flux, a nozzle positioned at the center over the container and adapted to cause dry air to flow out through a slit opened out in all horizontal directions, and an air pipe for supplying the dry air, which is connected to the nozzle. According to the apparatus, a powdery flux having strong deliquescence is always kept a completely dry state.

3 Claims, 2 Drawing Sheets

MOISTURE SEALING APPARATUS FOR POWDERY BRAZING FLUX

BACKGROUND OF THE INVENTION

1. Field of the Invention

The present invention relates to a moisture sealing apparatus for a powdery flux for metal brazing, in particular, a powdery flux used in brazing of aluminum, copper or the like and having deliquescence, and more specifically to a moisture sealing apparatus for a powdery flux, which is useful upon applying the flux to a filler rod by means of an automatic mechanism.

2. Description of the Related Art

Chloride fluxes are used in metal brazing, in particular, brazing of aluminum. As the chloride fluxes, zinc chloride, sodium chloride, lithium chloride and potassium chloride are generally used either singly or in any combination thereof. These chloride fluxes are in the form of powder. Therefore, the tip of a filler rod is wetted with water or an aqueous mixture with a suitable binder added to water before use of a powdery flux so as to apply the flux thereto, thereby conducting brazing. However, since these chlorides all show strong deliquescence, a flux comprising, as a main component, any one of these chlorides absorbs moisture in the air and is wetted by the moisture when it is allowed to stand in the air. Accordingly, the flux aggregates into a number of small lumps whenever the filler rod dipped into the liquid is inserted into the flux, so that the flux becomes crumbly and difficult to adhere to the filler rod. Before long, the flux deliquesces and becomes soft and sticky, leading to an utter impossibility of its use.

The present inventor previously proposed a container for preventing the moisture absorption of these deliquescent fluxes (Japanese Patent Application Laid-Open No. 126666/1988). This container is such that an air box is provided under a container for containing a powdery flux therein through a screen, and this air box is connected to a source of dry air supply.

However, in the above-described flux container, dry air is blown into the container through a very fine-mesh screen from under the powdery flux. Therefore, the meshes of the screen are partly clogged with the flux when the flux is used for long time, so that the passage of the air becomes deflected. The flux situated at portions where the passage of the air has become ill is hence not satisfactorily dried, and is wetted to aggregate into lumps. As a result, a vicious circle that the passage of the air is increasingly prevented arises. Accordingly, there has been a disadvantage that it requires time and labor in that the occurrence of clogging of the screen must be always monitored to clean the screen.

In addition, when the flux contained in the container decreases, partial blow-by of the air arises, which makes it impossible to evenly introduce dry air. Therefore, the amount of the flux contained in the container has also had to be monitored.

SUMMARY OF THE INVENTION

In order to improve the above disadvantages, the present invention has as its object the provision of a moisture sealing apparatus for always keeping a powdery flux having strong deliquescence a completely dry state.

The present inventor has carried out extensive investigation and development with a view toward achieving the above object. As a result, it has been experimentally confirmed that when an air curtain of dry air is laid down on the surface of a powdery flux container to prevent humid open air from entering the flux container, the moisture absorption of the flux can be effectively prevented, thus leading to completion of the present invention.

In an aspect of the present invention, there is thus provided a moisture sealing apparatus for a powdery brazing flux, comprising an open-topped container for the powdery brazing flux, a nozzle positioned at the center over the container and adapted to cause dry air to flow out through a slit opened out in all horizontal directions, and an air pipe for supplying the dry air, which is connected to the nozzle.

In order to better enhance the effect of the air curtain by the dry air, the nozzle may also be positioned in such a manner that the vertical height of the slit lies between the height of the powdery flux container and the level of the surface of the flux contained in the container.

Further, in order to make the effect of the air curtain by the dry air more complete, the powdery flux container may be contained in an envelope which is a size larger in both height and external diameter than the container, and the nozzle may be positioned in such a manner that the vertical height of the slit lies between the height of the powdery flux container and the height of the envelope.

According to the present invention, a powdery flux having a particle size of 200–350 mesh is contained in the powdery flux container of the present invention, and dry air of (the dew point −15° C.) to (the dew point −70° C.) is supplied through the slit opened out in all horizontal directions and defined in the nozzle positioned at the center over the container. The dry air flowed out of the nozzle is heavy in specific gravity and hence flows along the surface of the flux, so that the so-called air curtain is formed on the surface of the flux so as to completely shield the flux from open air. Accordingly, the air curtain of the dry air prevents the flux from absorbing moisture in open air, and moreover, the moisture absorbed in the flux is removed by the dry air to increase the dryness of the flux.

At this time, when the nozzle is positioned in such a manner that the vertical height of the slit lies between the height of the powdery flux container and the level of the surface of the flux contained in the container, the dry air flowed out through the slit fills up a space between the surface of the flux contained in the flux container and the top of the flux container, and then flows outside the container over an open edge of the container. Therefore, the surface of the flux can be completely covered with the dry air to prevent the flux from absorbing the moisture in open air.

Further, when the powdery flux container is contained in the envelope which is a size larger in both height and external diameter than the container, and the nozzle is positioned in such a manner that the vertical height of the slit lies between the height of the powdery flux container and the height of the envelope, the dry air covered on the surface of the flux in the container in the above-described manner flows outside the container over the open edge of the container. However, the dry air heavy in specific gravity flows down into a recess defined between the envelope provided outside the flux container and the flux container to fill up the recess, and then flows outside the envelope over an open edge of the envelope.

Since the whole flux container is surrounded with the dry air as described above, the moisture sealing effect of the dry air becomes complete.

Other objects and advantages of the present invention will be readily appreciated from the preferred embodiments of this invention, which will be described subsequently in detail with reference to the accompanying drawings.

DETAILED DESCRIPTION OF THE INVENTION AND PREFERRED EMBODIMENTS

The present invention will hereinafter be described by preferred embodiments with reference to the drawings.

EXAMPLE 1

Figure 1:
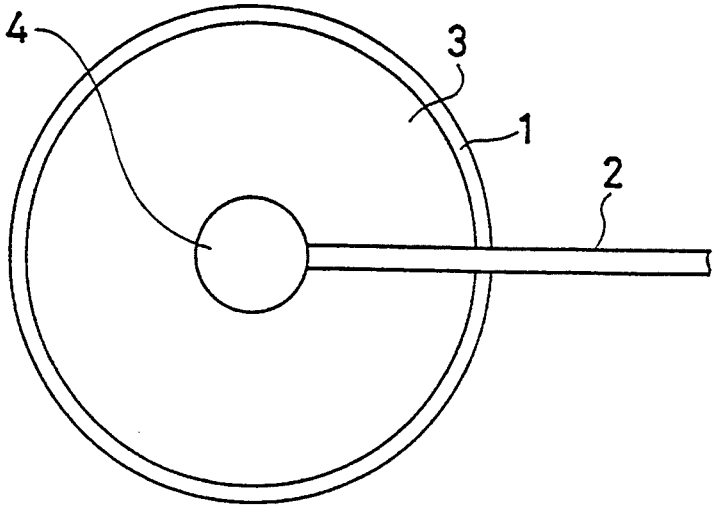
FIG. 1 is a plan view of a moisture sealing apparatus for a powdery brazing flux according to an embodiment of the present invention.
Figure 2:
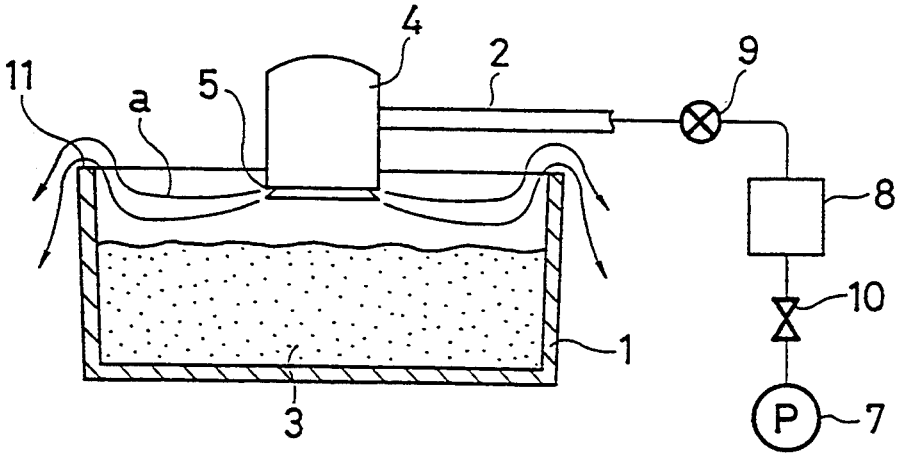
FIG. 2 is a side elevational view partially in cross section of the apparatus shown in FIG. 1.
Figure 3:
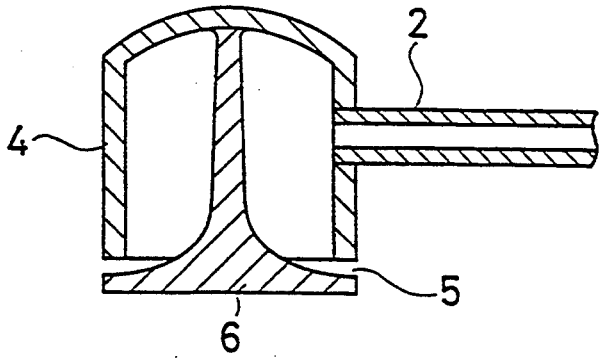
FIG. 3 is an enlarged sectional view of a nozzle part of the apparatus.

FIG. 1 is a plan view of a moisture sealing apparatus for a powdery brazing flux according to an embodiment of the present invention, FIG. 2 is a side elevational view partially in cross section of the apparatus shown in FIG. 1, and FIG. 3 is an enlarged sectional view of a nozzle part of the apparatus.

In the drawings, numerals 1, 2 and 4 indicate a container for containing a powdery flux 3 therein, an air pipe and a nozzle attached to the tip of the air pipe, respectively. The nozzle 4 is in the form of a tumbler with the bottom up. A slit 5 opened out in all horizontal directions is defined between the circumferential surface of a straightening plate 6 suspended from the interior of the nozzle 4 and having the shape of an inverted V in section and an open edge of the nozzle 4. The nozzle 4 is arranged in such a manner that the vertical height of the slit 5 lies between the surface of the flux 3 contained in the container 1 and an open edge 11 of the flux container 1. Numerals 7, 8, 9 and 10 designate an air pump, an air dehumidifier, a flow control valve and a pressure control valve, respectively.

The operation of the apparatus will then be described.

First of all, a chloride flux of 300 mesh is contained in the flux container 1. On the other hand, air pumped out by the pump 7 is dried to (the dew point −60° C.) in the air dehumidifier 8 and sent to the nozzle 4 via the flow control valve 9 through the air pipe 2. The dry air introduced into the tumbler-like nozzle 4 from its side wall flows down along the straightening plate having the shape of an inverted V in section and flows out in all horizontal directions through the slit 5. At this time, as indicated by a character a, the dry air heavy in specific gravity, which has been caused to flow through the slit 5, flows along the surface of the flux 3 and then outside the container 1 over the open edge 11 because the slit 5 is positioned below the open edge 11 of the container 1.

As described above, the surface of the flux is completely covered with the dry air. Therefore, the flux is prevented from the contact with open air, and moreover, the moisture on the surface of the flux is absorbed off by the dry air, so that the surface of the flux is always kept a dry state.

EXAMPLE 2

Figure 4:
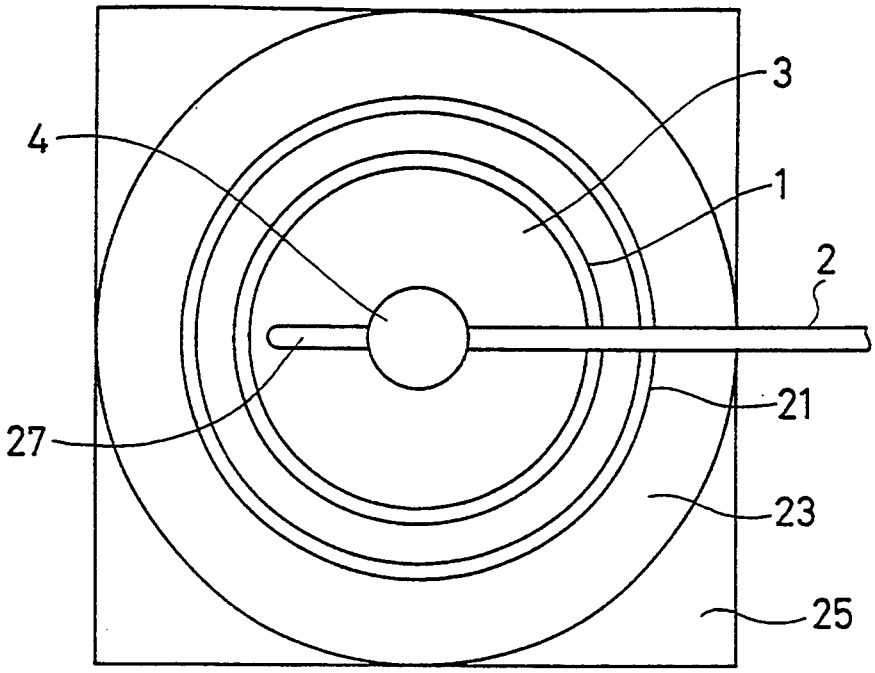
FIG. 4 is a plan view of a moisture sealing apparatus for a powdery brazing flux according to another embodiment of the present invention.
Figure 5:
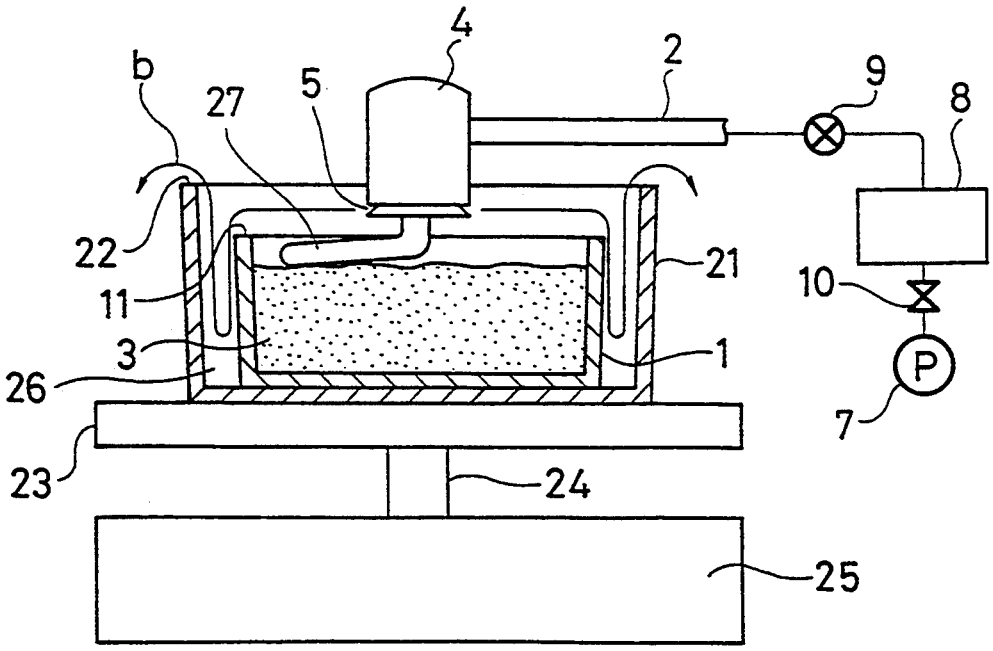
FIG. 5 is a side elevational view partially in cross section of the apparatus shown in FIG. 4.

FIG. 4 is a plan view of a moisture sealing apparatus for a powdery brazing flux according to another embodiment of the present invention, and FIG. 5 is a side elevational view partially in cross section of the apparatus shown in FIG. 4.

In the drawings, numerals 21, 22, 23, 24, 25, 26 and 27 indicate an envelope provided outside the flux container 21, an open edge 22 of the envelope 21, a turntable 23, a rotating shaft 24, a base 25, a recess 26 defined between the container 1 and the envelope 21, and a leveling rod 27, respectively.

The operation of the apparatus will then be described.

The envelope 1 in which the flux container 1 has been contained is mounted on the turntable 23 which is rotated through the rotating shaft 24 by a motor installed in the base 25 and not illustrated. On the other hand, air pumped out by the pump 7 and dried by the air dehumidifier 8 is sent to the nozzle 4 through the air pipe 2. The slit 5 in the nozzle 4 is positioned above the open edge 11 of the container 1 but below the open edge 22 of the envelope 21. Therefore, as indicated by a character b, the dry air, which has been caused to flow through the slit 5, flows along the surface of the flux 3 and overflows the open edge 11 of the container 1 to stay in the recess 26 between the container 1 and the envelope 21. The dry air further flows outside the envelope 22 over the open edge 22 of the envelope 21. In this manner, the flux 3 contained in the container 1 is completely covered with the dry air, so that the flux 3 incurs no possibility that open air enters the flux container, and the powdery flux is hence always kept a dry state.

On the other hand, since the flux container 1 is rotated by the rotation of the turntable 23, the surface of the flux 3 in the flux container 1 is always leveled by the leveling rod 27 fixed to the straightening plate 6. Therefore, when a filler rod is inserted into the flux container by a robot of an automatic brazing machine to apply the flux to the tip of the filler rod, the flux is always evenly applied to the filler rod, so that automatic brazing can be always evenly conducted.

As described above, since the moisture sealing apparatus for a powdery brazing flux according to the present invention is equipped with the nozzle positioned at the center over the open-topped powdery flux container and adapted to cause dry air to flow out through a slit opened out in all horizontal directions, the dry air suppled from this nozzle flows outward along the surface of the powdery flux and then outside the container over the open edge of the container. Therefore, the surface of the flux can be surrounded by the dry air, thereby completely shielding the flux from humid open air. Accordingly, even if a chloride powdery flux high in deliquescence is used, a brazing operation can be always smoothly conducted without moistening the flux. Besides, dry air of (the dew point −15° C.) to (the dew point −70° C.) is supplied from the source of air supply, and this dry air is heavy in specific gravity, so that it flows along the surface of the powdery flux. Therefore, even when the flux has been moistened, it can be completely dried to supply it to a brazing operation in a dry state, whereby the quality of a brazed product can be improved.

Although the present invention has been described above with reference to the preferred embodiments thereof, it is to be understood that the invention is not limited thereto and that various modifications and changes in form and details can be made therein without departing from the spirit and scope of the invention.

What is claimed is:

1. A moisture sealing apparatus for powdery brazing flux, comprising an open-topped container having a powdery brazing flux therein, a single nozzle positioned at the center over the container having a slit opened out in all horizontal directions, an air pipe supplying dry air connected to the nozzle and means connected to said nozzle for forcing the dry air to flow out through the slit in the horizontal directions of the slit over an entire surface of the brazing flux.

2. A moisture sealing apparatus for a powdery brazing flux, comprising an open-topped container having a powdery brazing flux, a nozzle positioned at the center over the container and adapted to cause dry air to flow out through a slit opened out in all horizontal directions, and an air pipe for supplying the dry air, which is connected to the nozzle, wherein the nozzle is positioned in such a manner that the vertical height of the slit lies between the height of the powdery flux container and the level of the surface of the flux contained in the container.

3. A moisture sealing apparatus for a powdery brazing flux, comprising an open-topped container having a powdery brazing flux, a nozzle positioned at the center over the container and adapted to cause dry air to flow out through a slit opened out in all horizontal directions, and an air pipe for supplying the dry air, which is connected to the nozzle, and further comprising an envelope which is a size larger in both external diameter and height than the container, wherein the powdery flux container is contained in the envelope, and the nozzle is positioned in such a manner that the vertical height of the slit lies between the height of the powdery flux container and the height of the envelope.

* * * * *